US007108643B2

(12) United States Patent
Wilson et al.

(10) Patent No.: US 7,108,643 B2
(45) Date of Patent: Sep. 19, 2006

(54) PUSH-UP DEVICE

(76) Inventors: Jeffrey Dale Wilson, 5447 Palace Ct., Goleta, CA (US) 93111; Jeff Jenneve, 4655 Gerona Way, Santa Barbara, CA (US) 93110; Daniel Steven Sanchez, 1140 Via Regina, Santa Barbara, CA (US) 93111

( * ) Notice: Subject to any disclaimer, the term of this patent is extended or adjusted under 35 U.S.C. 154(b) by 0 days.

(21) Appl. No.: 11/082,139

(22) Filed: Mar. 15, 2005

(65) Prior Publication Data

US 2005/0215401 A1 Sep. 29, 2005

Related U.S. Application Data

(60) Provisional application No. 60/556,348, filed on Mar. 24, 2004.

(51) Int. Cl.
*A63B 26/00* (2006.01)
*A63B 71/00* (2006.01)

(52) U.S. Cl. ..... 482/141; 482/62; 21/665

(58) Field of Classification Search ..... 482/141, 482/62, 70; D21/692, 665, 674
See application file for complete search history.

(56) References Cited

U.S. PATENT DOCUMENTS

| | | | | |
|---|---|---|---|---|
| 5,205,802 | A * | 4/1993 | Swisher | 482/141 |
| 6,186,930 | B1 * | 2/2001 | Ignaczak | 482/141 |
| 6,315,701 | B1 * | 11/2001 | Shifferaw | 482/114 |
| 6,716,145 | B1 * | 4/2004 | Manailovich | 482/141 |
| 6,932,750 | B1 * | 8/2005 | Dorner | 482/142 |
| 2005/0148448 | A1 * | 7/2005 | Mersch | 482/141 |

* cited by examiner

*Primary Examiner*—Lori Amerson
(74) *Attorney, Agent, or Firm*—Michael G. Petit

(57) ABSTRACT

An elongate floor-supported platform having sliding handgrips mounted thereon. In a preferred embodiment, the handgrips, which are constrained to move only along a track, which may be linear or curvilinear and lying in a substantially horizontal plane, are interconnected by linking means such as belts. The linkage is such that the handgrips remain equidistant from a fixed centerline midway between the handgrips throughout their range of motion. In the preferred embodiment, the linking means are belts that are supported by pulleys housed within the floor-supported platform. In yet a further embodiment, the platform includes wall and/or ceiling attachment means and can be employed for performing pull-ups.

12 Claims, 2 Drawing Sheets

PUSH-UP DEVICE

REFERENCE TO RELATED APPLICATIONS

This application claims the benefit of U.S. Provisional Application Ser. No. 60/556,348, filed Mar. 24, 2004.

BACKGROUND OF THE INVENTION

1. Field of the Invention

The present invention relates to an exercise device and, more particularly, to a push-up device comprising a floor-supportable platform having a pair of handgrips slidably mounted thereon.

2. Prior Art

Ignaczak, in U.S. Pat. No. 6,186,930, provides a description of the prior art relating to the present invention, and the discussion of the prior art recitated in '930 is incorporated herein by reference thereto. Ignaczak '930 discloses a push-up trainer having a base and a pair of handgrip assemblies. The handgrip assemblies are each slidably mounted to the base, permitting lateral movement of the handgrips during use. Each handgrip assembly allows for rotation of each handgrip around a vertical axis and around its horizontal lengthwise axis. Each of the sliding and rotational motions may selectively be allowed or locked out using a spring biased pin. The handgrips may be set a fixed distance apart along the platform or they may slide relative to one another. The '930 device lacks means for maintaining the handgrips equidistant from a centerline between the handgrips during motion thereof. Thus, when performing push-ups, the center of mass of the exerciser may not be positioned over the centerline and may result in an imbalance with possible injury. There remains a need for a push-up device which is supportable by a floor and wherein the handgrips are slidably mounted and remain equidistant from a fixed centerline therebetween throughout the range of sliding motion of the handgrips.

SUMMARY

It is an object of the present invention to provide an exercise device comprising an elongate floor-supportable platform having a pair of slidably mounted handgrips thereon. The slidably mounted handgrips, which are constrained to move only along a track which may be linear or curvilinear and lie in a substantially horizontal plane, are interconnected by linking means such as belts. The linkage is such that the handgrips remain equidistant from a fixed centerline midway between the handgrips throughout their range of motion. In a preferred embodiment, the push-up device of the present invention comprises: (a) an elongate platform having first and second ends and a midpoint therebetween; (b) first and second handgrips slidably mounted on the platform and disposed equidistant from the midpoint of the platform wherein the handgrips can be moved along a substatially horizontal track; and (c) handgrip coupling means connecting the first handgrip to the second handgrip, the coupling means being operable for maintaining the first and second handgrips equidistant from the midpoint of the platform when the first and second handgrips are moved along the track.

Each of the handgrips may also include adjustable braking means operable for either dampening or preventing the sliding action of the handgrips with respect to the platform. The platform includes floor supporting means and can be used for performing pushups. In yet a further pull-up embodiment, the platform includes wall or ceiling attachment means and modified handgrips such that the platform may be mounted on a wall and the device can be employed for performing pull-ups. In yet a further embodiment, the platform is suspended from a ground-based support stand.

The features of the invention believed to be novel are set forth with particularity in the appended claims. However the invention itself, both as to organization and method of operation, together with further objects and advantages thereof may be best understood by reference to the following description taken in conjunction with the accompanying drawings.

DESCRIPTION OF THE PREFERRED EMBODIMENTS

Figure 1:
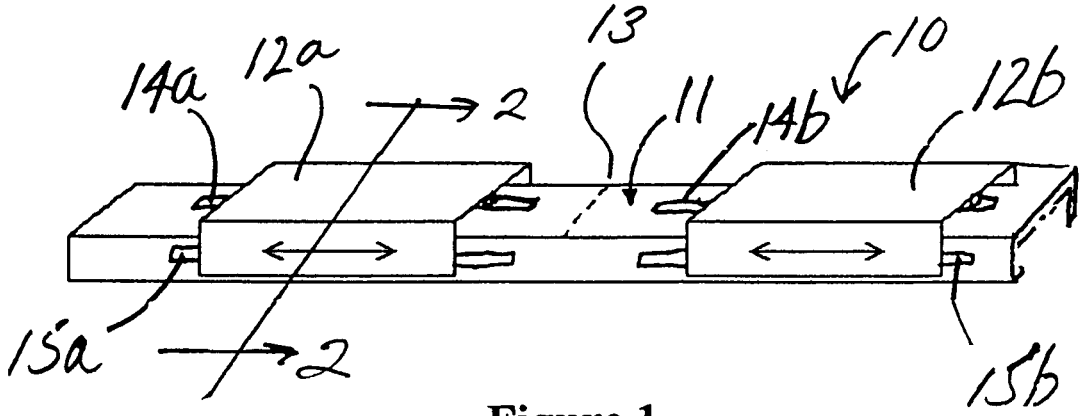
FIG. 1 is a perspective view of a platform having a pair of handgrips slidably mounted thereon wherein the handgrips are always equidistant from a centerline.
Figure 2:
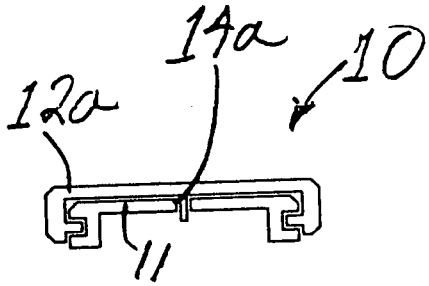
FIG. 2 is a cross-sectional view of the push-up device 10 of FIG. 1 taken along section line 2—2.

Turning now to FIG. 1, a preferred embodiment of a push-up device in accordance with the present invention is indicated at numeral 10. The device 10 comprises an elongate platform 11 having a pair of handgrips 12*a* and 12*b* attached thereto. The handgrips are disposed equidistant from a centerline 13 midway between the handgrips. An exerciser (not shown) places his/her hands on the handgrips 12*a* and 12*b* that are slidably attached to the platform 11. As the push-up progresses, the handgrips 12*a* and 12*b* may move laterally, as indicated by the double-headed arrows, toward and away from the centerline 13. The ability of the hands to move inwardly or outwardly during a push-up enables the use of more (and different) muscles than with stationary handgrips. The guides 14*a* and 14*b* in the platform 11 constrain the direction and extent of travel of the handgrips. Slots 15*a* and 15*b* further serve to guide and limit the extent of travel of the handgrips. FIG. 2 is a cross-sectional view showing a preferred mechanical relationship between the handgrip 12*a* and the platform 11.

Figure 3:
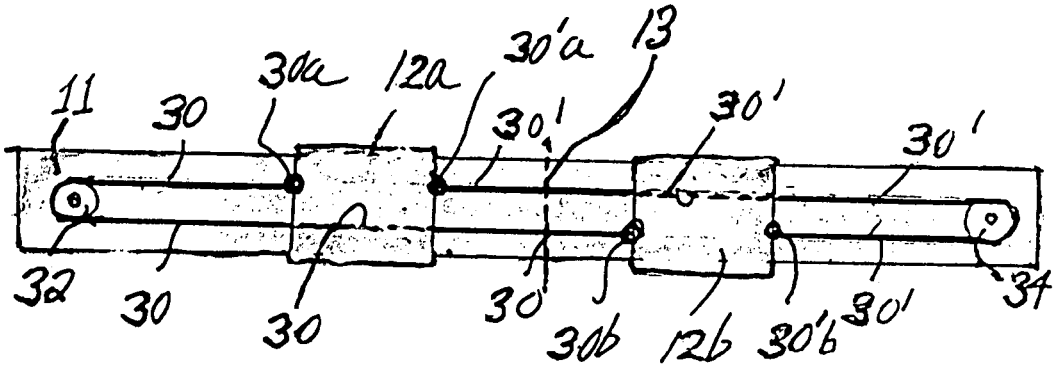
FIG. 3 is a schematic view showing the interconnection of the handgrips by a single pair of belts housed within the platform.

FIG. 3 is a top schematic view of the first preferred embodiment of a push-up device in accordance with the present invention showing the interconnection of the handgrips 12*a* and 12*b* by a pair of belts 30 and 30' housed preferably within the platform 11. With continued reference to FIG. 3, belt 30 is segmented into first and second belts 30 and 30' of equal length. A first end 30*a* of the first belt segment 30 is attached to a lateral end of handgrip 12*a*. The opposing end 30*b* of the first belt segment 30 is guided around pulley 32 and to a medial end of handgrip 12*b*. A first end 30'*a* of primary belt segment 30' is attached to the medial end of handgrip 12*a* and extends around pulley 34 to be attached to the lateral end of handgrip 12*b* at point 30'*b*, thereby completing the interconnection of the handgrips. The interlinking belt assembly provides means for maintaining an equal distance between the handgrips and the center 13 of the platform 11 when sliding the handgrips in an axial direction. The handgrips 12*a* and 12*b* may be modified to include grasping means 42 (FIG. 4) operable for grasping by the exercisor's hand. The grasping means 42 may be rotatably mounted on the upper surface of the handgrips 12*a* and 12*b*.

Figure 4:
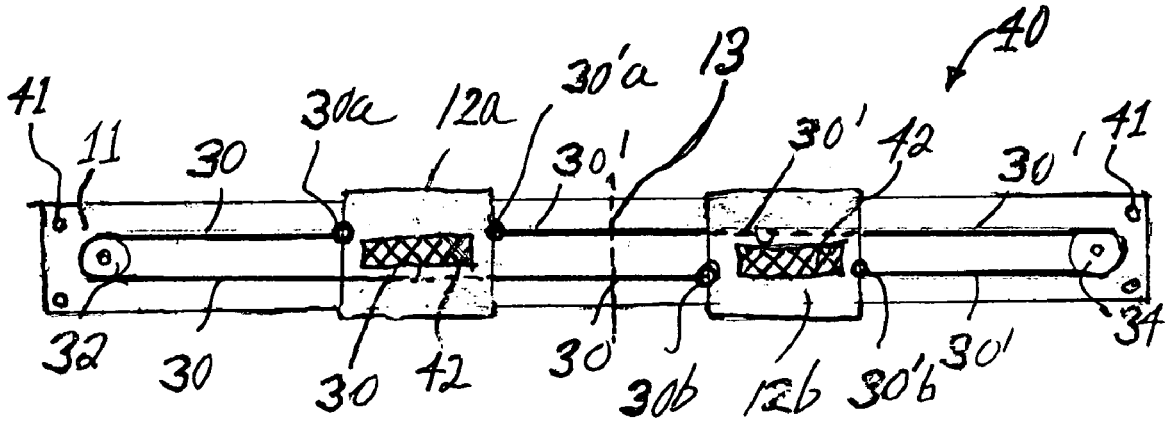
FIG. 4 is a schematic view of a pull-up device wherein the platform of the device illustrated in FIG. 3 is modified to enable wall or ceiling mounting thereof, and the handgrips are modified to enable a person to use the device for performing pull-ups.

The device 10 can be readily adapted for performing pull-ups. FIG. 4 is a schematic view of a pull-up device 40 wherein the platform 11 of the device 10, illustrated in FIG. 3, is modified to include wall or ceiling mounting means 41, such as screws, operable for enabling the wall or ceiling mounting of the platform, and wherein the handgrips 42 are modified to enable the handgrips to be encircled by the fingers while a person performs pull-ups. In addition, the device 10 in accordance with the pull-up embodiment 40 can be suspended from a ground-based support stand (not shown).

While a particular embodiment of the present invention employing interconnecting belts as handgrip centering means has been illustrated and described, it would be obvious to those skilled in the art that various other changes and modifications can be made without departing from the spirit and scope of the invention. For example, damping means can be employed to provide adjustable resistance to the axial motion of the handgrips. The handgrips may also be adapted to include manually adjustable stops operable for locking the handgrips in a preferred position on the platform. The gripping portion of the handgrips 12*a*, 12*b* and 42 may be of any desired shape and may be rotatable about a handgrip axis. Further, the platform 11 may be made with a pivot point therein disposed on midline 13. Such a pivot point will permit the direction of the guides or tracks for each handgrip to be symmetrically varied from 0–180 degrees. It is therefore intended to cover in the appended claims all such changes and modifications that are within the scope of this invention.

What is claimed is:

1. A device operable for enabling a person to perform push-ups comprising: (a) an elongate platform having first and second ends and a midpoint therebetween; (b) first and second handgrips slidably mounted on said platform and disposed equidistant from said midpoint wherein said first handgrip is constrained to slide along a line between said midpoint and said first end of said platform and said second handgrip is constrained to slide along a line between said midpoint and said second end of said platform; and (c) handgrip coupling means connecting said first handgrip to said second handgrip, said coupling means being operable for maintaining said first and second handgrips equidistant from said midpoint of said platform when the first and second handgrips are moved.

2. The device of claim 1 wherein said first and second handgrips have an upper surface facing away from said platform and include grasping means on said upper surface.

3. The device of claim 2 wherein said grasping means is rotatably attached to said upper surface.

4. The device of claim 1 wherein said first and second handgrips include adjustable braking means operable for either dampening or preventing the sliding action of the first and second handgrips with respect to the platform.

5. The device of claim 1 wherein said platform includes floor supporting means.

6. The device of claim 2 wherein said first and second handgrips include adjustable braking means operable for either dampening or preventing the sliding action of the first and second handgrips with respect to the platform.

7. The device of claim 1 wherein said line is straight.

8. The device of claim 1 wherein said line is curvilinear.

9. The device of claim 2 wherein said line is straight.

10. The device of claim 2 wherein said line is curvilinear.

11. A device enabling a person to perform pull-ups comprising: (a) an elongate platform having first and second ends and a midpoint therebetween, and wall or ceiling mounting means thereon operable for attaching said platform to a wall or ceiling; (b) first and second handgrips slidably mounted on said platform and disposed equidistant from said midpoint wherein said first handgrip is constrained to slide along a line between said midpoint and said first end of said platform and said second handgrip is constrained to slide along a line between said midpoint and said second end of said platform; and (c) handgrip coupling means connecting said first handgrip to said second handgrip, said coupling means being operable for maintaining said first and second handgrips equidistant from said midpoint of said platform when said first and second handgrips are moved.

12. The device of claim 11 wherein said first and second handgrips include adjustable braking means operable for either dampening or preventing the sliding action of said first and second handgrips with respect to said platform.

* * * * *